US006857705B2

(12) United States Patent
Hainsworth et al.

(10) Patent No.: US 6,857,705 B2
(45) Date of Patent: Feb. 22, 2005

(54) MINING MACHINE AND METHOD

(75) Inventors: David William Hainsworth, Westlake (AU); David Charles Reid, Karana Downs (AU)

(73) Assignee: Commonwealth Scientific and Industrial Research Organization, Campbell (AU)

( * ) Notice: Subject to any disclaimer, the term of this patent is extended or adjusted under 35 U.S.C. 154(b) by 25 days.

(21) Appl. No.: 10/258,342

(22) PCT Filed: Apr. 23, 2001

(86) PCT No.: PCT/AU01/00463

§ 371 (c)(1),
(2), (4) Date: Oct. 21, 2002

(87) PCT Pub. No.: WO01/81726

PCT Pub. Date: Nov. 1, 2001

(65) Prior Publication Data

US 2003/0075970 A1 Apr. 24, 2003

Related U.S. Application Data

(60) Provisional application No. 60/203,901, filed on May 12, 2000.

(30) Foreign Application Priority Data

Apr. 26, 2000 (AU) ..... PQ7131

(51) Int. Cl.[7] ..... E21C 35/08
(52) U.S. Cl. ..... 299/1.7; 299/1.6; 405/302
(58) Field of Search ..... 249/1.6, 1.7; 405/302

(56) References Cited

U.S. PATENT DOCUMENTS 4,111,487 A 9/1978 Mullins
4,134,270 A * 1/1979 Small et al. ..... 405/302
4,412,700 A 11/1983 Zitz et al.
4,643,482 A 2/1987 Wolfenden
4,822,105 A * 4/1989 Yamada et al. ..... 299/1.6
4,887,935 A * 12/1989 Koppers et al. ..... 405/302
5,020,860 A * 6/1991 Bessinger et al. ..... 299/1.6
5,275,469 A * 1/1994 Geuns et al. ..... 299/1.7
6,481,802 B1 * 11/2002 Kussel ..... 299/1.6

FOREIGN PATENT DOCUMENTS

DE 41 42 165 A1 4/1993

OTHER PUBLICATIONS

EPO Supplementary European Search Report on Application No. EP 01 92 5198, dated Jun. 3, 2003, 4 pages.

Partial translation of German Application No. De 41 42 165 A1, 2 pages.

* cited by examiner

*Primary Examiner*—Sunil Singh
(74) *Attorney, Agent, or Firm*—Merchant & Gould P.C.

(57) ABSTRACT

A control system for a mining machine which moves in passes across a seam to be mined using absolute coordinates is disclosed. The machine is carried on rail and co-ordinates of the rail are measured along the length of rail. The rail is then moved to a new position for a next pass, and the distance of moving is determined from the co-ordinates previously measured. By knowing the co-ordinates, the rail can be moved to assume a desired profile, so that a desired profile of the seam can be achieved on the next pass. Co-ordinates of the up and down movement of a shearing head can also be measured and stored with the co-ordinates along the rail to provide a profile of the seam being cut, and so that on a next pass the intended position of the shearing head can be predicted and moved accordingly.

20 Claims, 12 Drawing Sheets

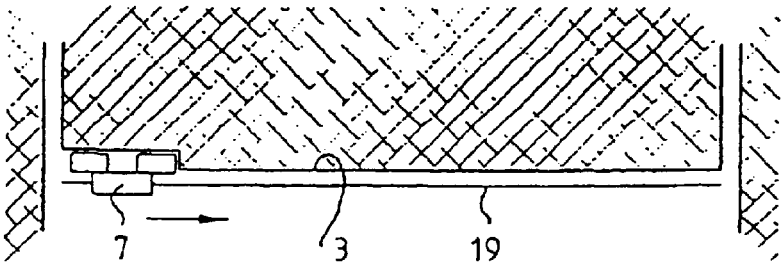
(a) Longwall shearer on guide rail at the start of longwall cut – pass 1
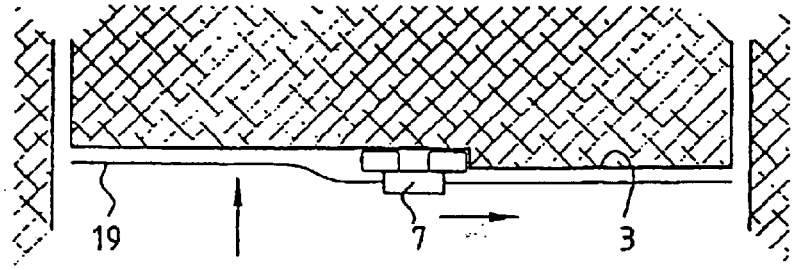
(b) As the shearer advances the longwall cut the rail is pushed forward behind it.
FIG. 4.
PRIOR ART
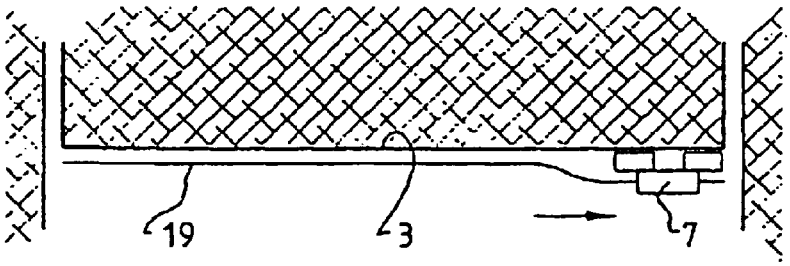
(c) Longwall shearer at the end of longwall cut –pass 1
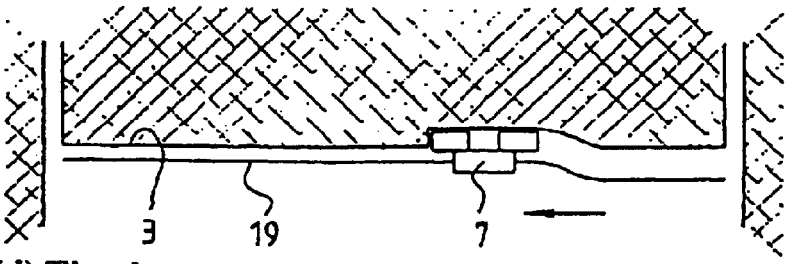
(d) The shearer reverses past the curve in the rail and cuts a pocket in the longwll face.

(e) The end of the rail is pushed forward.

(f) The shearer moves to the end of the rail cutting the material from the start of longwall cut – pass 2

(g) The shearer then proceeds with longwall cut – pass2. The rail is again pushed forward behind the shearer.

(h) The longwall shearer guide rail and longwall face develop a curvilinear path after many passes.

MINING MACHINE AND METHOD

This application is based on and claims the benefit of the filing date of U.S. provisional application No. 60/203,901 filed May 12, 2000, and Australian application PQ7131 filed Apr. 26, 2000.

FIELD OF THE INVENTION

This invention relates to a mining machine and method whereby a mining machine can be controlled to move across a seam containing product to be mined. The invention has particular, although not exclusive application, in the longwall mining of coal.

DESCRIPTION OF PRIOR ART

In the mining of coal, processes have been developed which are referred to as longwall mining processes. In these processes a movable rail is placed to span across a coal seam. A mining machine is provided with a shearing head and the mining machine is moved to traverse along the rail from side-to-side of the seam, and the shearing head is manipulated upwardly and downwardly to shear coal from the face of the seam. Throughout each pass, the rail is moved forwardly toward the seam behind the path of the mining machine. The mining machine is then caused to traverse the seam in the opposite direction whilst the shearing head is manipulated upwardly and downwardly to remove further coal from the seam. The process is repeated until all coal in the planned extraction panel is completed.

Thus, by advancing the rail means forwardly towards the seam by a suitable distance after each pass, it is possible to progressively move into the seam with an approximate equal depth of cut with each pass.

In practice, inaccuracies develop with each subsequent pass due to slippage of a powered roof support advance system which moves the rail, resulting in the depth of cut varying across the face of the seam. This, in turn, leads to reduced production yields and unnecessary mechanical loading and stresses on the rail and powered roof support advance system. Such inaccuracies are attributable, in large part to the fact that the powered roof support advance system moves the rail forwardly by a set incremental amount at each pass. Thus, because of the slippage of the powered roof support advance system, the inaccuracies accumulate after many passes of the machine. Desirably, the rail is expected to extend in a straight line, but, because of the slippage, the rail is progressively moved so that it eventually has a curvilinear or snake like path. This, in turn, results in down time in attempting to reposition the rail to correct these accumulated inaccuracies.

Many systems have been developed for repositioning and maintaining the rail means on a desired straight line across the face of the seam. Simple systems use a string line. Other systems use optical means which produce light beams which reflect off reflectors strategically placed at the sides of the seams. Radar systems have also been proposed. None have proved satisfactory as they each require time to set-up, and manual adjustment of some or all of the support powered roof supports.

In addition to the above, a coal seam follows contours and folds in the strata structure and therefore the coal seam is not a predictable shape. This, in turn, has led to difficulties in causing the shearing head to accurately follow the seam on a predictable basis at each pass. If the shearing head attempts to shear into the coal seam boundary into the much harder roof and floor stone material this produces unnecessary and undesirable loadings on the drive motors of the shearing head and results in inefficient yields and production dilution.

It is therefore desirable to know the absolute position of the mining machine at sufficient points across the face of the seam for each successive shear so that the vertical contour (ie horizon) can be predicted and the vertical up and down movement of the shearing head can be controlled and dynamically adjusted to cause the mining machine to follow the undulating coal seam (horizon control). Existing methods of horizon control include a reactive method based on detecting and reacting to the increased load on the cutting drum motors when the shearing head is raised or lowered beyond the coal seam. This reactive technique results in mechanical stress and product dilution due to the inclusion of non-coal material. Another method referred to as "mimic cut" uses sensors to record the vertical limits of the shearer head under manual control throughout a complete pass across the coal face. The system then attempts to automatically replicate this shearing pattern through a next pass. This approach does not take into account the undulation in the seam in the direction of longwall progression. Radar and natural gamma sensors have also been proposed as a means of detecting the coal seam boundary. However, these systems are not always suitable and in any case require human intervention.

OBJECT AND STATEMENT OF THE INVENTION

It is therefore an object of examples of the present invention to attempt to overcome one or more problems of the prior art machines.

Therefore, according to a first broad aspect of the present invention there may be provided a mining machine having a shearing head mounted on a moveable carriage, said shearing head being for mining product from a seam as said moveable carriage traverses from side-to-side across a mining face of said seam on rail means which extend from side-to-side across the seam, said machine having co-ordinate position determining means for determining the co-ordinate position of the machine at each of a plurality of locations along the rail means, the co-ordinate position at each of the plurality of locations being at least 2D co-ordinate position information, and means for providing data signals representative thereof, processing means connected to receive the data signals representative of the 2D co-ordinate position information and to generate output signals processed therefrom and useable to control rail moving means associated with said machine, so said rail moving means will attempt to displace a trailing part of said rail means a distance towards said seam based on the current co-ordinate position of that part of the rail means, to assume a co-ordinate position of an intended profile for the next pass, said processing means operating with said rail moving means at various locations along the length of the rail means, so that on the next pass of said moveable carriage, said shearing head will attempt to cut to the intended profile.

Most preferably the intended profile is a straight line in a generally horizontally extending plane.

Most preferably said processing means includes memory means for storing electrical signals of the 2D co-ordinates provided by said co-ordinate position determining means at each of said plurality of locations.

Most preferably said signals are useable by said processing means to calculate the required distance of movement of the rail means at various locations.

Most preferably said co-ordinate position determining means provides 3D co-ordinate position signals in each of the X,Y and Z planes.

Most preferably said processing means stores a horizon profile of either the up or down or both locations of the shearing head at locations along the rail means, so that on a next pass said shearing head can be predictably controlled by shearing head position control means to be moved to positions which cause said shearing head to traverse a predicted horizon profile determined from the previous pass, whereby the shearing head can move to predicted folds or contours of the seam.

A method of controlling a mining machine having a moveable carriage carrying a shearing head so said shearing head will cut to an intended profile, said method including mounting said carriage on rail means which traverse from side-to-side across a seam to be mined, providing position signals of the 2D co-ordinate position of said machine at each of a plurality of locations along the rail means to processing means as said machine passes from side-to-side across the seam, generating output signals processed from said position signals to control rail-moving means, effecting operation of said rail moving means so a trailing part of said rail means will be displaced a distance forwardly toward said seam based on the current co-ordinate position of the rail means, operating said rail moving means at various positions along the length of the rail means so said rail means will attempt to be in said intended profile so that on a next pass of said moveable carriage said shearing head will attempt to cut the intended profile.

Most preferably said rail moving means is a series of independently moveable moving means spaced apart along the length of said rail means and wherein each is connected at one end to a respective mine roof support means, each roof support means providing fixed positions for the one ends of each moving means when supporting a mine roof, and wherein the other ends of said moving means are connected to said rail means, so that when the other ends of said moving means are moved away from said roof support means the rail means can be moved forwardly towards said seam.

Most preferably each of said moving means is independently moveably so that when said rail means has been moved forwardly by said moving means, and a respective mine roof support means released from supporting said mine roof, the respective roof support means can be displaced forwardly towards said rail means by said moving means and wherein said rail means then provides fixed positions for the other ends of each moving means.

Most preferably said processing means determines the amount of forward movement of said roof support means so that at completion of a pass of said mining machine along said rail means there is a substantially straight line wall across the seam, and so all the roof support means will then be inline with said line being substantially parallel with said rail means.

BRIEF DESCRIPTION OF THE DRAWINGS

In order that the invention can be more clearly ascertained examples of preferred embodiments will now be described with reference to the accompanying drawings wherein.

DETAILED DESCRIPTION OF THE PREFERRED EMBODIMENT

Figure 1:
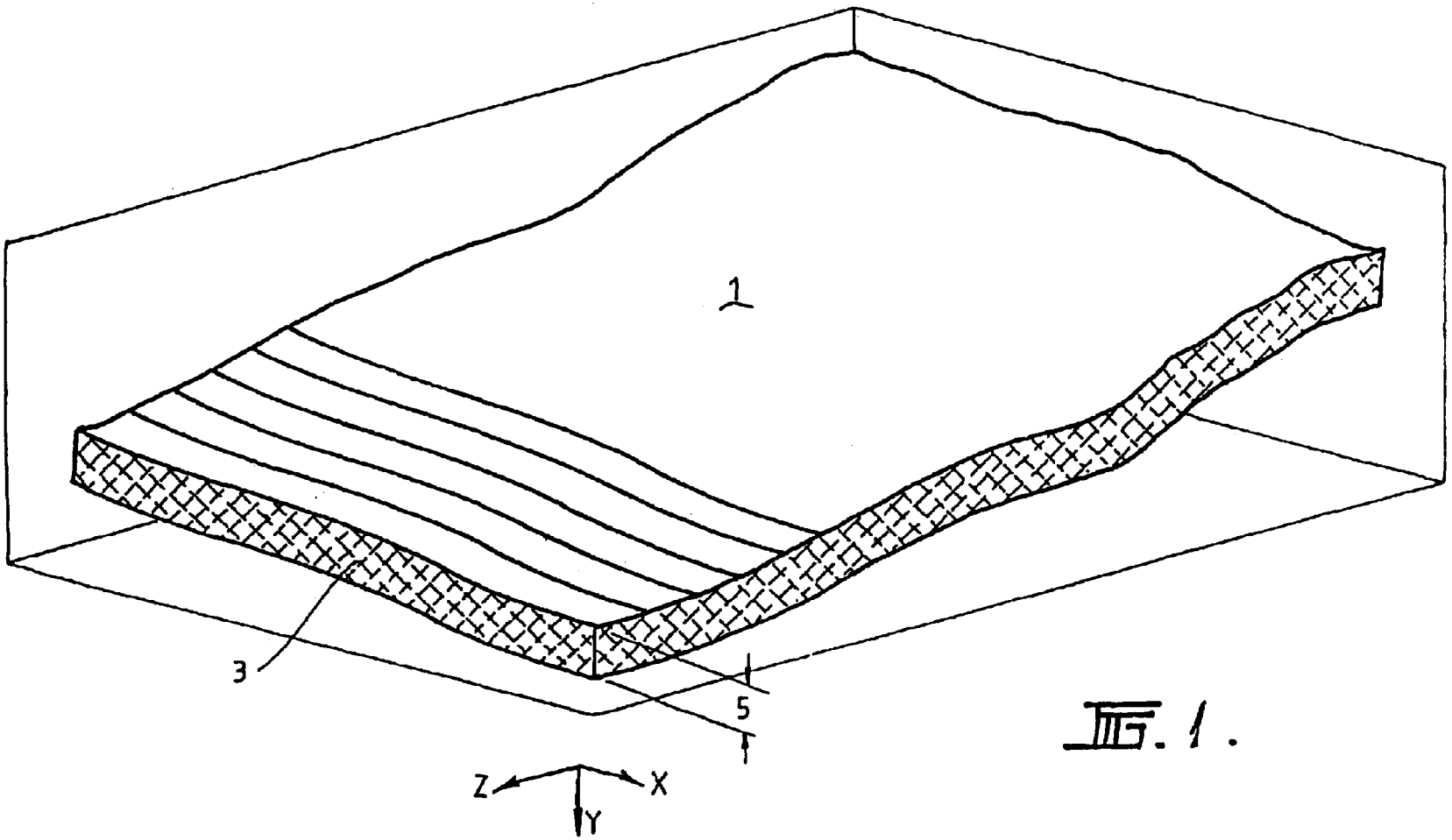
FIG. 1 is a diagrammatic view of a coal seam showing the undulations therein and the relative change in elevation of the seam along its length.

Referring firstly to FIG. 1 there is shown a seam 1 of coal relative to X, Y, and Z planes. FIG. 1 is diagrammatic and shows an upward inclination of the seam 1 together with folds and contours throughout the seam 1. The strata below and above the seam has not been shown. The seam 1 has a longwall face 3 and a vertical depth or thickness indicated by thickness 5. The depth or thickness 5 is typically, substantially uniform throughout the whole of the seam 1.

When mining the seam 1, a mining machine attempts to make a series of side-to-side cuts across the seam. Each cut is represented by the narrow line markings across the seam 1. In other words, the longwall face 3 is exposed progressively with each succeeding side-to-side cut. It can be seen that as the side-to-side cuts progress in a direction generally orthogonal to the longwall face 3 (ie in the Z direction) the horizon aspect changes upwardly. This is merely exemplary as in other examples, the horizon aspect may extend downwardly. In addition, the seam 1 is shown as having a generally horizontal aspect along the X axis. The seam may have an inclination along the X axis. In other words, FIG. 1 merely shows one possible type of seam 1 configuration. This change needs to be predicted to enhance efficiencies in the mining process.

Figure 2:
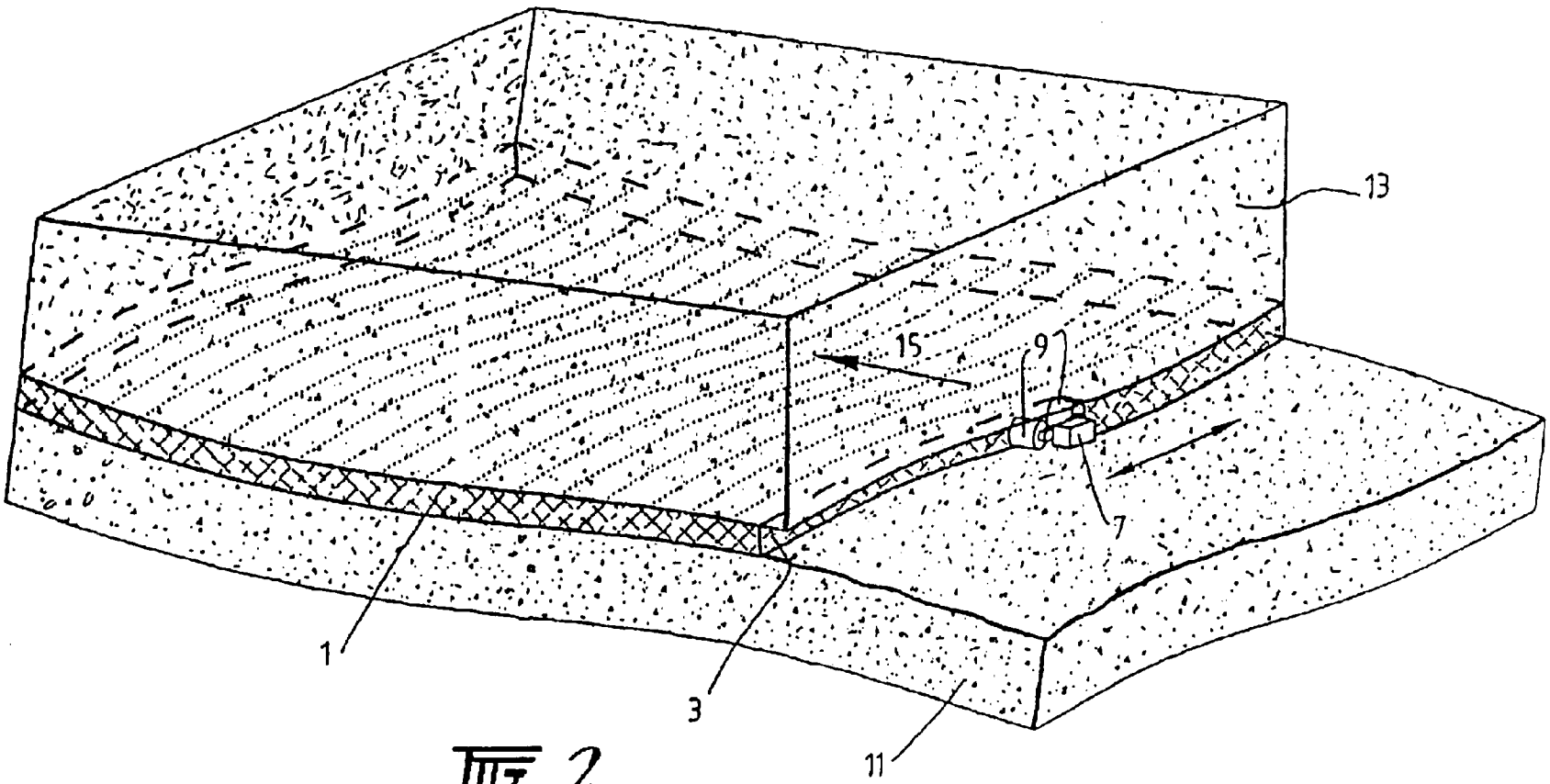
FIG. 2 is a diagrammatic view showing the coal seam and a shearing machine during a traverse from side-to-side across the seam during the removal of coal therefrom.

Referring now to FIG. 2 there is diagrammatically shown how a mining machine 7 carrying shearing heads 9 can move across the longwall face 3 of the seam 1. The mining machine 7 therefore moves over the upper surface of strata 11 below the seam 1, and underneath the lower surface of strata 13 above the seam 1. As the machine progresses forwardly in the direction shown by arrow 15 after each side-to-side pass, it progressively mines the coal or other material in the seam 1.

Figure 3:
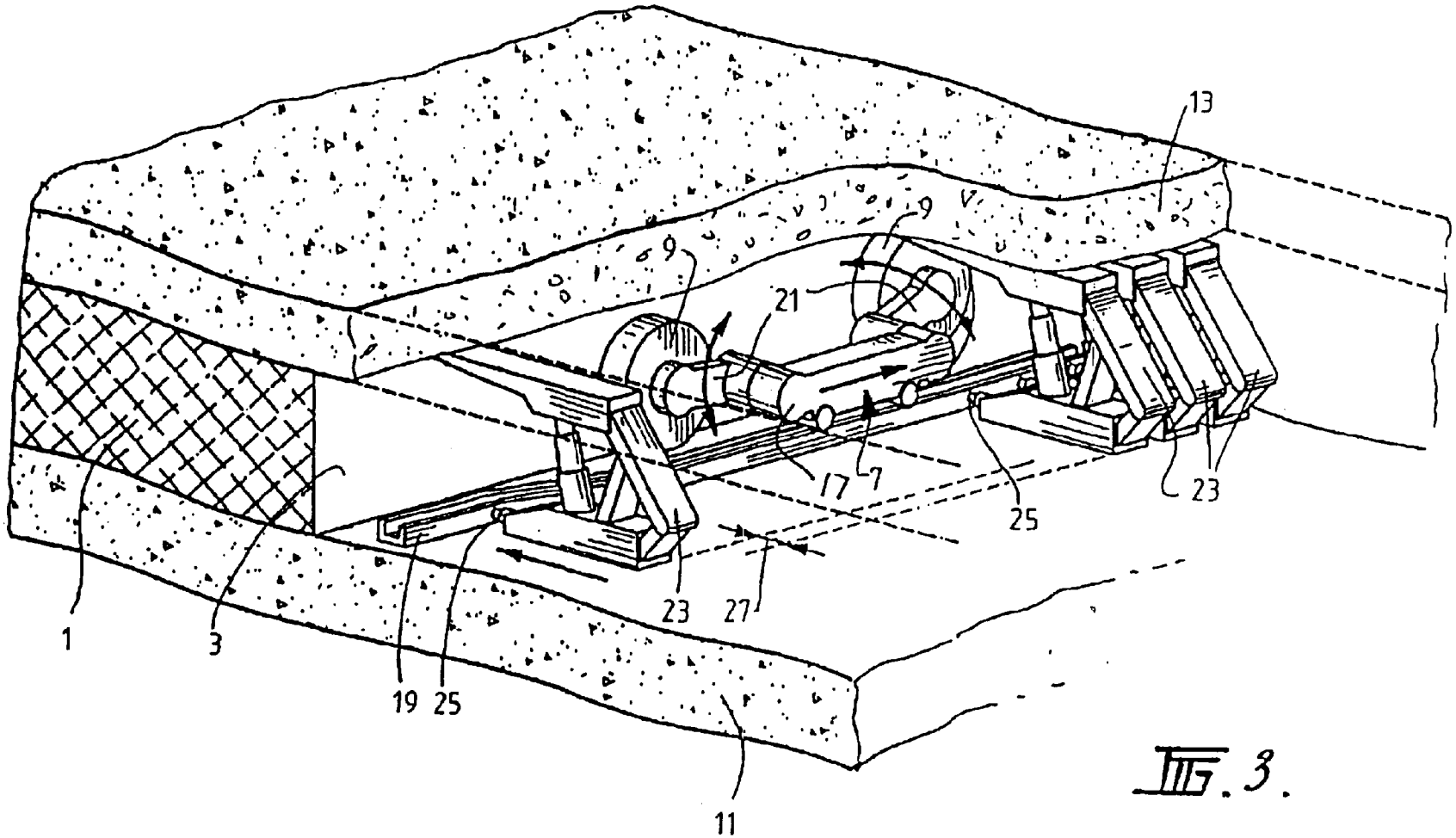
FIG. 3 is a detailed close-up view showing the coal seam and the underlying and overlaying strata together with a prior art mining machine which moves from side-to-side across the long wall face of the seam.

FIG. 3 shows the arrangement in close-up detail. It also shows that the mining machine 7 includes a movable carriage 17 which is mounted on rail means 19 in the form of a track so that it can traverse thereon from side-to-side across the longwall face 3 of the seam 1. The moveable carriage 17 carries swingable anns 21 which, in turn, support shearing heads 9 at each end of the moveable carriage 17. The arms 21 can swing upwardly and downwardly whilst the movable carriage 17 can traverse the rail means 19. FIG. 3 also shows that a plurality of powered mine roof support means 23 are positioned between the overlying strata 13 and the underlying strata 11 so as to support the mine roof. The roof support means 23 are known roof support means. The roof support means 23 are each, in turn, connected with moving means 25 which can be used to move the rail means 19. Each of the moving means 25 is independently movable and the powered roof support means are spaced apart along the length of the rail means 19. In FIG. 3, several of the roof support means 23 have purposely not been shown in order to clearly expose the mining machine 7. It should be understood, however, that in use, the roof support means 23 extend along the length of the longwall face 3 at substantially equally spaced intervals and provide support for the overlying strata 13. As the machine 7 advances pass-by-pass into the seani 1, the roof support means 23 are individually released from supporting the overlying strata 13 and are displaced forwardly. The overlying strata 13 behind the roof support means 23 is then allowed to collapse into the free space made by the mining. Thus, the moving means 25 of each of the roof support means 23 is connected at one end to the roof support means 23 and at the other end to the rail means 19. As the mining machine 7 passes a roof support means 23, the moving means 25 is activated to displace a trailing part of the rail means 19 a distance forward towards the seam 1. The roof support means 23 acts as a fixed point at one end of the moving means. The distance moved is shown as distance 27 in FIG. 3. After the rail means 19 has been displaced forwardly towards the seam 1, the roof support means 23 can be released from supporting the roof strata 13 and the moving means 25 then used to pull the roof support means 23 towards the rail means 19. All other roof support means 23 remain in their original positions supporting the roof during this movement. The above process is repeated at each of the roof support means 23 so that the rail means 19 is displaced forwardly toward the seam 1 as the mining machine 7 passes. On completion of movement of the rail means 19 by each roof support means, the rail means then serve as a fixed point for displacing the roof support means 23 towards the rail means 19. In this way, as the machine 7 passes across the longwall face 3, the roof support means 23 support the roof or strata 13 above the seam 1 and then the roof support means 23 act as a fixed point against which the moving means 25 can operate to displace the rail means 19 towards the seam 1. Following movement of the rail means 19 towards the seam 1 the roof support means 23 can be released from supporting the roof and strata 13 such that the roof support means 23 can be moved toward the rail means 19. The rail means then act as a fixed point for pulling the roof support means towards the rail means.

Figure 4:
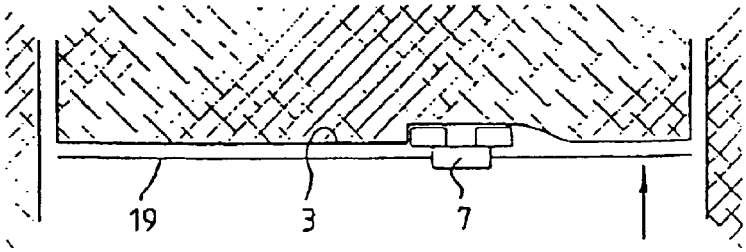
FIG. 4. PRIOR ART
FIGS. 4*a*–4*h* are plan views, in diagrammatic form, showing a prior art mining machine during several passes.
Figure 4:
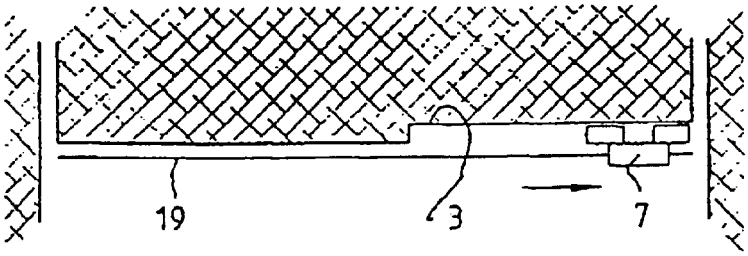
FIG. 4. PRIOR ART
Figure 4:
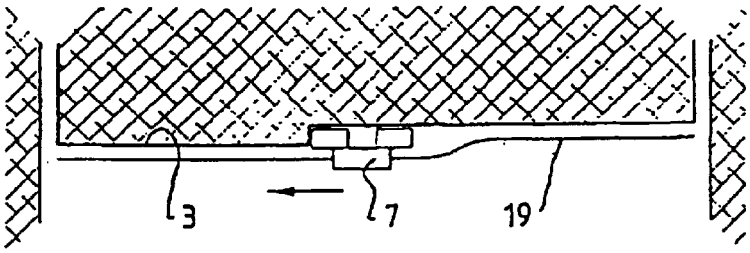
FIG. 4. PRIOR ART
Figure 4:
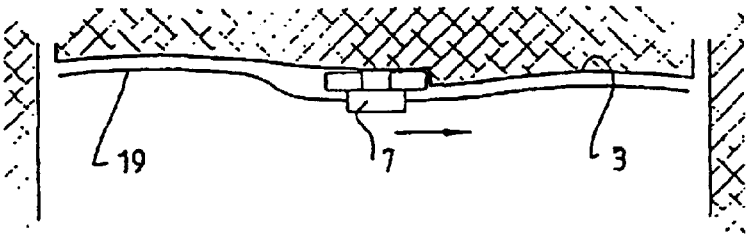
FIG. 4. PRIOR ART

Referring now to FIG. 4 there is shown a series of plan view diagrams 4*a*–4*h* which show a typical longwall mining process. Each of FIGS. 4*a*–4*h* is annotated to show various stages in the passing of the machine 7 across the longwall 3. FIG. 4*h* shows the extreme condition which occurs in the prior art where a curvilinear or snake path is developed after many passes due to the inaccurate determination of the position of the rail means and slippage of the roof support means as the rail means is moved many times over many passes. The various systems used in the past for positioning the rail means 19 and for controlling the mining machine 7 have resulted in inefficiencies in mining techniques as discussed in the introductory portion of this specification. The embodiment of the present invention attempts to overcome the difficulties of the prior art by precisely determining the position of the rail means by determining the 2D co-ordinate position of the rail means and then calculating the required movement required to place the rail in a desired profile for the next pass.

Figure 5A:
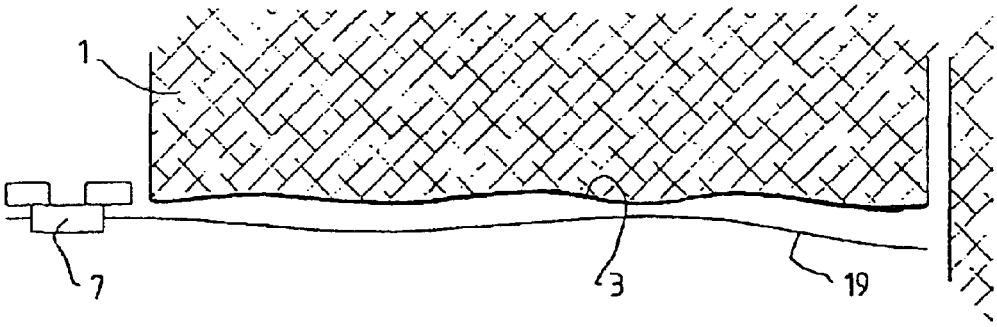
FIGS. 5*a*–5*c* are a series of plan views, looking onto a horizontal plane, of a mining machine of a preferred example of the invention, mining into a coal seam.
Figure 5B:
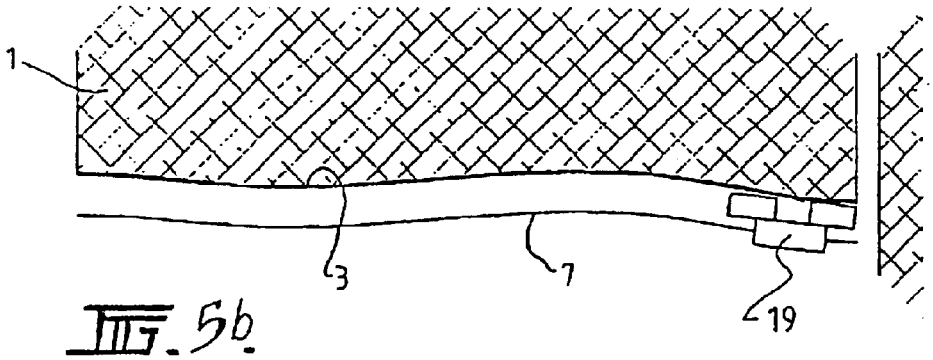
Figure 5C:
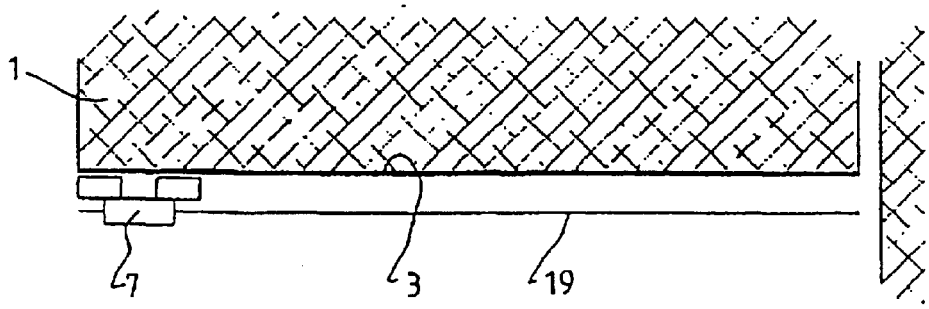

Reference will now be made to FIGS. 5*a* to 5*c* to explain a simplified example of an embodiment of the present invention. In FIGS. 5*a* to 5*c*, a series of plan views are shown of a coal seam 1, similar to that in FIG. 4.

Rail means 19 extend across the longwall face 3, and the mining machine 7 traverses the rail means 19. Each of the views in FIGS. 5*a*–5*c* is a plan view showing the seam 1 and the rail means 19 in an approximate horizontally extending plane. It should be recognised, that coal seams typically extend transversely in a generally horizontally extending plane however, there are undulations and inclinations as exemplified in FIGS. 1 and 2.

FIG. 5*a* shows the seam 1 with a longwall face 3 prior to commencement of mining using the mining machine 7. It can be seen that the rail means 19 extends in front of the longwall face 3. Typically, the profile of the rail means 19 is to be a straight line. The mining machine 7 is shown at the extreme left hand side of the seam 1 prior to making a pass to the right hand side of the seam 1. It can be seen that the coal longwall face 3 has a profile which is different to the profile of the rail means 19.

FIG. 5*b* shows the arrangement after a first pass of the mining machine 7. Here it can be seen that the profile of the longwall face 3 now replicates the profile of the rail means 19.

FIG. 5*c* shows that the profile of the rail means 19 has been adjusted to a desired profile, in this case a straight line, by appropriately moving the rail means 19 at various locations behind the mining machine 7. It is possible to assume a desired profile of the rail means 19, and a corresponding profile of the longwall face 3, by knowing the co-ordinate positions of the mining machine 7 at various locations along the rail means 19. This is because the mining machine is carried by the rail means, and the co-ordinate positions of the mining machine are directly related to the position of the rail means at those locations. Thus, the co-ordinate positions are preferably determined from a fixed point on the mining machine and the current position of the rail means is related to the fixing point. In a variation the co-ordinate positions may be determined using co-ordinate determining means mounted on the rail means directly and not on the moveable mining machine. Those locations may correspond exactly with the positions where powered roof support means connect with the rail means 19 or there may be many intermediate locations. In other words, the number of locations along the rail means 19 where the co-ordinate positions of the mining machine 7 are determined, may be far greater in number than the number of powered roof support means. Accordingly, it is assumed that the mining machine 7 will traverse the rail means 19 and the shearing head 9 will cut into the seam 1 so that the longwall face 3 replicates the profile of the rail means 19. In other words, the distance from the rail means 19 to the coal face 3 will be an equal distance across the seam 1. As the position of the rail means 19 is known by the co-ordinate positions at the various locations, it is possible to calculate the required movement forward required of the rail means 19 to place the rail means 19 in a position to assume a required profile. Typically, this required profile is a straight line. It is also assumed that the distance of each roof support means to be moved forwardly, so that the rail means assumes the required profile, is the required distance without any slippage of the roof support means. In practice, some slippage may occur however, the system is such that it will always be able to determine the current position of the mining machine (ie the rail means 19) at the various locations and thus any calculation of the required distance of movement to assume the required profile will always be based on the current position and not the expected position. Thus, using the techniques of the present invention the problems of the rail means 19 assuming a non desired curvilinear path or snake path after many passes can be minimised. Moreover, it is now not necessary to shutdown the mining machine 7 to attempt to straighten the rail means 19 after many passes as has been the case in the prior art systems as the profile of the rail means is either the same as the desired profile or approximately so. In addition, because it is now possible to attempt to place the rail means 19 to assume a desired profile, small adjustments can be purposely made with the system to incline the rail means 19 relative to the coal face 3 to attempt to move the whole rail means 19 and mining machine 7 either upwardly or downwardly in a tilt type arrangement to compensate for any gradual creepage of the mining machine 7 and rail means 19 to one side or the other of the seam 1 as would occur if the machine were attempting to mine in the seam 1 shown in FIG. 1 which slopes dramatically upwardly, and particularly so if the right hand side of the seam falls away relative to the left hand side or vice versa.

In FIG. 5*a*, a two dimensional co-ordinate position of the machine is first determined prior to commencing cutting. This is typically a Northing and Easting co-ordinate position of the machine. This sets a datum for the machine. The simple system described above enables the profile of the rail means 19 to be determined on a first pass. During this process the longwall face 3 replicates the profile of the rail means 19 as shown in FIG. 5*b*. On the next pass, the rail means 19 can be moved to assume a desired profile. As stated previously, this desired profile is typically a straight line but could be any other required profile.

It may also require several passes and corresponding movements of the rail means to reach a desired profile, as the roof support means 23 have only a limited movement capability each time they are activated.

Figure 5D:
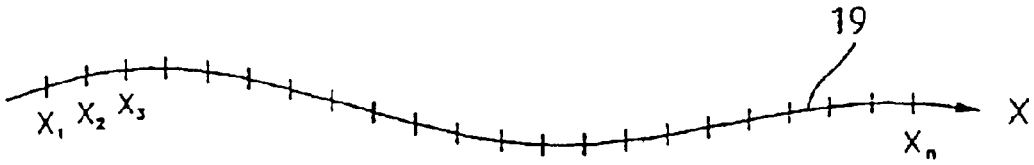
FIGS. 5*d*–5*f* are diagrammatic views showing profiles and movements of the rail means on which the mining machine moves.

FIG. 5*d* shows the profile of the rail means 19 (similar to that shown in FIG. 5*a*). FIG. 5*d* also shows a number of locations $X_1$ $X_2$ $X_3$ . . . $X_n$ along the length of the rail means 19 where the co-ordinates are measured.

Figure 5E:
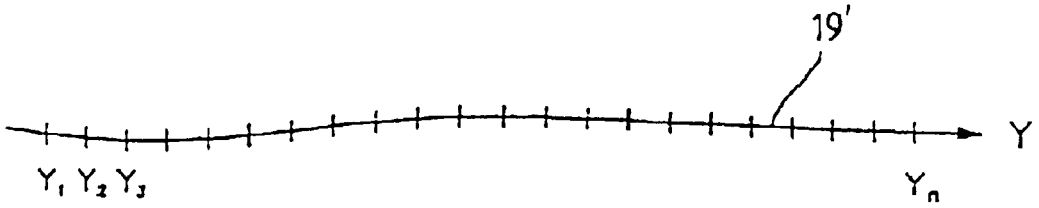
Figure 5F:
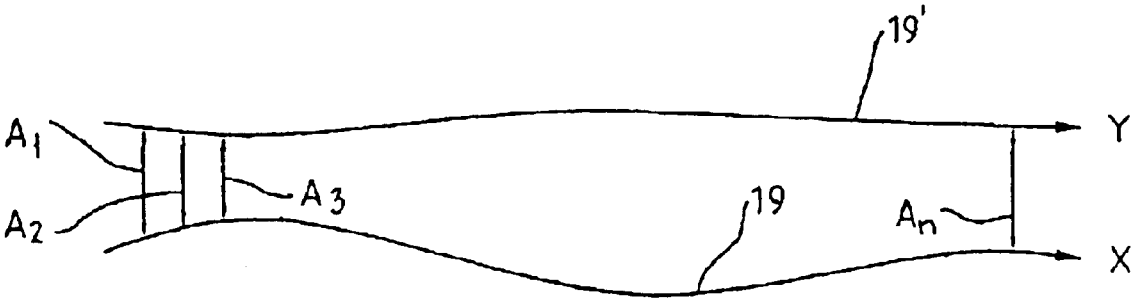
Figure 5Q:
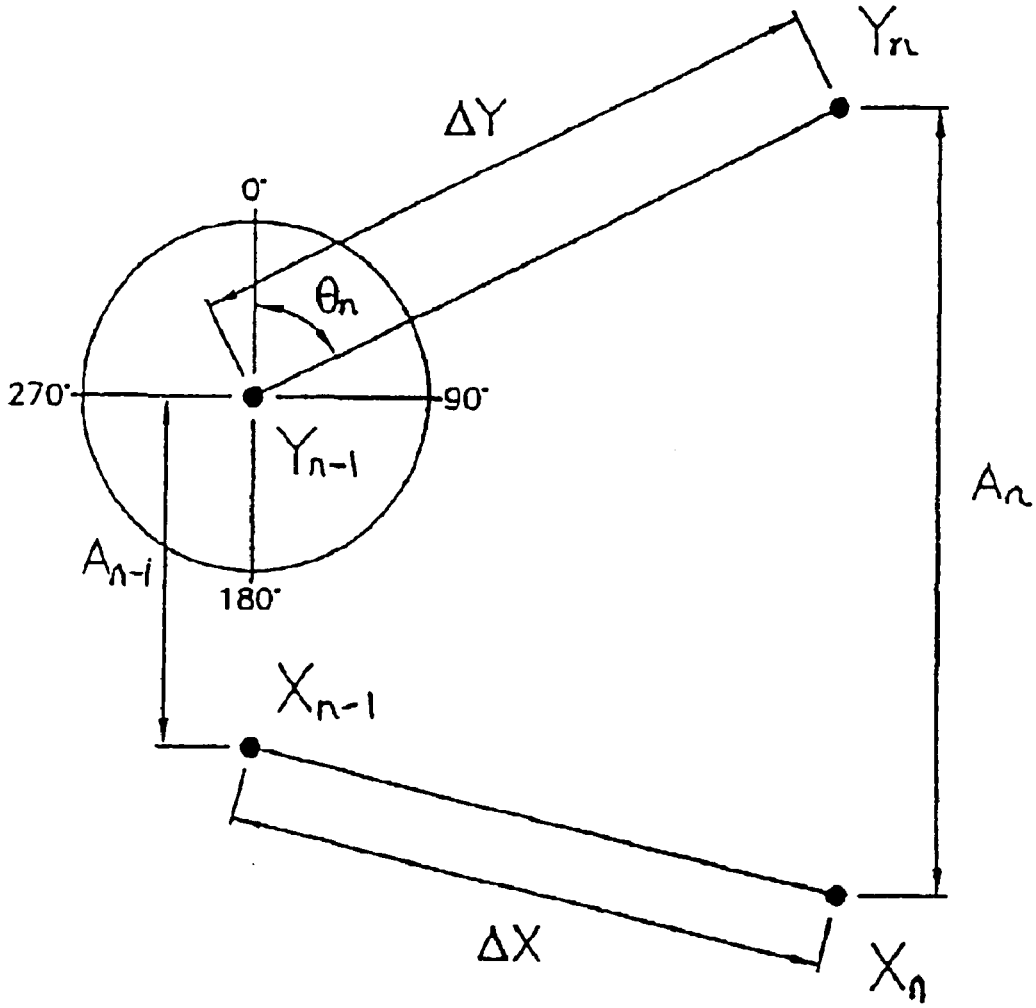
FIG. 5*g* is a diagram showing angle $\theta_n$ between a current rail means position and a new position at two points.

FIG. 5*e* shows the desired profile 19⁻ of the rail means 19 and shows a corresponding number of locations $Y_1$ $Y_2$ $Y_3$ . . . $Y_n$ at the same incremental locations as $X_1$ $X_2$ etc, in FIG. 5*d*. It is assumed that ΔX and ΔY are the differences between two adjacent locations and both ΔX and ΔY remain constant. Then, at each of the locations represented by the vector quantities $X_1$ $X_2$ $X_3$ $X_4$ . . . $X_n$, the heading of the machine can be used to determine the co-ordinates at these locations as follows:

$$X_{n-Xn-1}+\Delta X\angle\theta_n$$

Where $\Delta X\angle\theta_n$ is a vector expressed in polar form having magnitude ΔX and angle $\theta_n$ where $\theta_n$ is a suitable constant valued representation of the heading of the machine throughout the actual path between locations $X_{n-1}$ and $X_n$. Preferably the coordinates are determined as Easting and Northing. The length of displacement $A_1$ $A_2$ $A_3$ . . . $A_n$ can then be determined to place the track 19 at the required position so that the desired profile will be obtained. This is shown in FIG. 5(*f*) and in FIG. 5(*g*)

$A_n$ at any given point can be expressed by the following:

$$A_n=|Y_n-X_n|$$

Where |X| denotes the magnitude of the vector X.

The above simple system can then be expanded to a 3D co-ordinate system where the altitude of the machine 7 is determine at each of the various locations $X_1$ $X_2$ $X_3$ . . . $X_n$. Thus, in this system, the co-ordinates are preferably determined using Northing, Easting, and altitude and define positions of the machine (and the rail means 19) and each of the position vectors $X_n$ is three dimensional. By knowing the 3 dimensional co-ordinates at each of the positions $X_1$ $X_2$ $X_3$ . . . $X_n$ it is possible to store a three dimensional profile of the coal seam.

Figure 6:
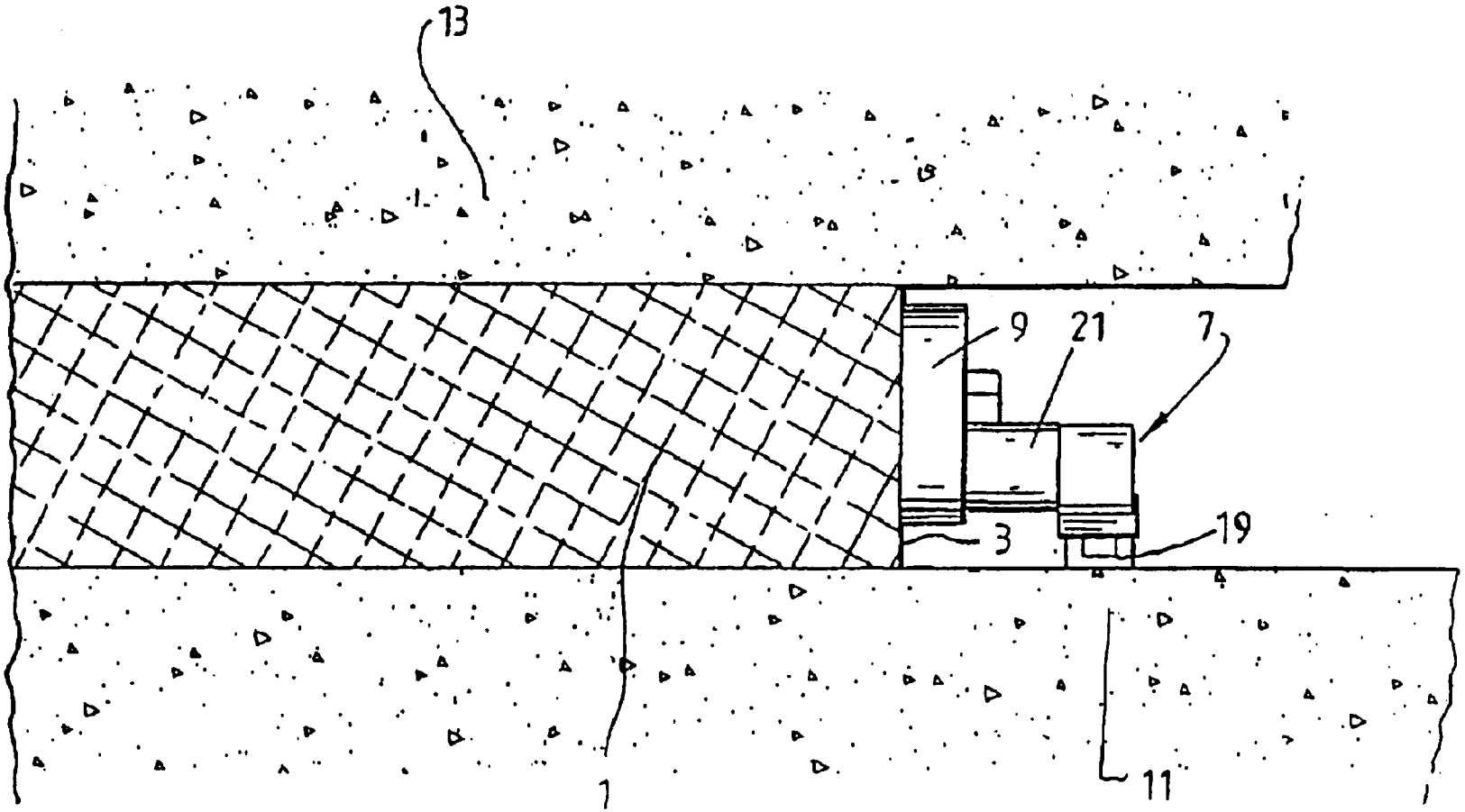
FIG. 6 is a side elevation view of the mining machine example FIGS. 5*a*–5*c;*

Referring now to FIG. 6, which is a side elevation of the mining machine example shown in FIGS. 5*a*–5*c*, the position of the mining machine 7 is determined in 3D co-ordinates and this, in turn, determines the position of the rail means 19. The shearing heads 9 are carried on swingable arms 21 and the up/down limits of movement of the shearing head 9 are also determined. Thus, as the mining machine 7 travels on the rail means 19, the shearing head 9 can be swung on the arms 21 to the upper and lower limits and information can be recorded at each of the positions $X_1$ $X_2$ $X_3$ . . . $X_n$ or other positions, as to the extent of the up/down swinging movement. This information can be recorded so a profile of either the upper or lower extremities or both of the seam 1 is stored. This can be used in subsequent passes of the mining machine 7 to predict the extent of upward and downward movement of the shearing head 9 to mine the particular seam 1.

In addition the storing of the co-ordinates at all positions, or selected positions along the rail means over a series of side-to-side passes, will provide a store of the profile of the seam itself.

In the example of the present invention, an inertial navigation system is used which determines position and orientation in three dimensions. Preferably, each of the three dimensions is based on X, Y, and Z co-ordinates. Typically, gyroscopic means is provided to measure the angular velocity in each of the three co-ordinates. The gyroscopic means may, in turn, be associated with accelerometers which are used to measure the 3D acceleration (linear) in the same co-ordinate dimensions. The accuracy and stability of the inertial navigation system can be further improved by incorporating information about the linear displacement of the system which can be obtained from the odometer attached to the mining machine. The signals provided for each of these dimensions are then processed to extract the linear position and angular rotation. This, in turn, uniquely defines the exact position of the machine 7 and rail means in space. It also defines the "attitude" of the machine 7. The "attitude" is representative of the azimuth, pitch, and roll of the machine 7 and therefore the corresponding position of the rail means 19.

Thus, when the concepts of precisely determining the position by 3D positioning means as outlined above are implemented, then processing means can be invoked to determine required distances of movement of the rail means 19 and shearing head 9. In a typical example, required movement in the X direction ie side-to-side across the seam 1 is controlled by linear transverse drive motor means mounted to the mining machine 7. The required movement in the Y direction (vertically) can only be controlled by adjusting the lower limit of the shearer head. The lower limit produces the floor upon which the rail will subsequently sit, so this determines the profile of the rail in the Y direction. The upper limit is important only from a maximum extraction perspective.

Determination of the lower limit can be achieved by various means, e.g. motor torque, gamma detection, mimic cut, visual reference etc. In this respect the inertial navigation system can be used to improve the accuracy, stability and overall effectiveness of these techniques. Once the lower limit is determined, appropriate drive means such as hydraulic motors may be employed to swing the arms 21, in subsequent side to side passes of the machine 7, so that the shearing heads 9 remove all possible relevant material from the seam 1 during each pass without unduly mining strata 11 or 13. Measurement of movement in the Z direction—ie in the direction of progression of mining—is determined from the inertial movement sensor. Thus, knowing the desired 3D absolute position of the mining machine 7 and knowing the distance of travel along the rail means 19 and the upper and lower limits of the seam in the Y direction, processing means can be employed based on those position signals to appropriately move the mining machine 7 relative to the rail means 19, and the shearing heads 9 relative to the mining machine 7, so that precise control of mining can be effected. Further, once knowing the precise position of the machine 7 and the displacement of the rail means 19 for a particular roof support means 23, the roof support means 23 can be then advanced forwardly a determined distance based on the current co-ordinate position so that each of the roof support means 23 is in line at completion of a pass of the mining machine along the rail means 19. In other words, the processing means can position the rail means 19 so that it is in a substantially straight line across the seam 1, and the processing means can also control positioning of the shearing heads 9 to maximise the mining process. In addition, the processing means can cause each of the roof support means 23 to be moved so that they are substantially in line with that line being substantially parallel with the rail means 19.

Thus, the processing means can provide output signals to effect forward movement to a preselected absolute position of the rail means. In addition, the output signals to the roof support means 23 can be provided to cause the mining machine to cut at a preselected absolute geodetic heading or angle relative to the shearing heads so they will cut at a preselected absolute geodetic heading or angle relative to the forward progression of the rail means into the seam.

In a modification of the example, the processing means may include memory means for storing information concerning the electrical signals provided by the position determining means at various points throughout the length of the pass of the machine 7. Thus, that information can then be used by the processing means as a datum from which to calculate the required rail means movement.

In a further example of a preferred embodiment of the present invention, the determining means provides signals in each of the X, Y, and Z planes, and stores a profile of the positions during each pass of the shearing head 9 along the rail means 7 so that on subsequent passes the shearing head 9 can be controlled by shearing head position control means (hydraulic motors or the like) to be moved upwardly or downwardly to positions which cause the shearing head 9 to traverse a similar profile as during the last pass but at a shearing depth determined from the forward position of the rail means. This enables a prediction to be made as to the likely or expected position of the shearing heads 9 during any subsequent pass so that the shearing heads 9 can follow pre-found folds or contours of the seam 1. As each pass occurs the profile will most likely change, however, the change can be predicted for the next cut or series of cuts. Thus, tighter control over mining can be achieved than with known prior art systems.

The position determining means outlined above are merely exemplary forms of typical position determining means which can be used and should not be considered limiting.

Figure 7:
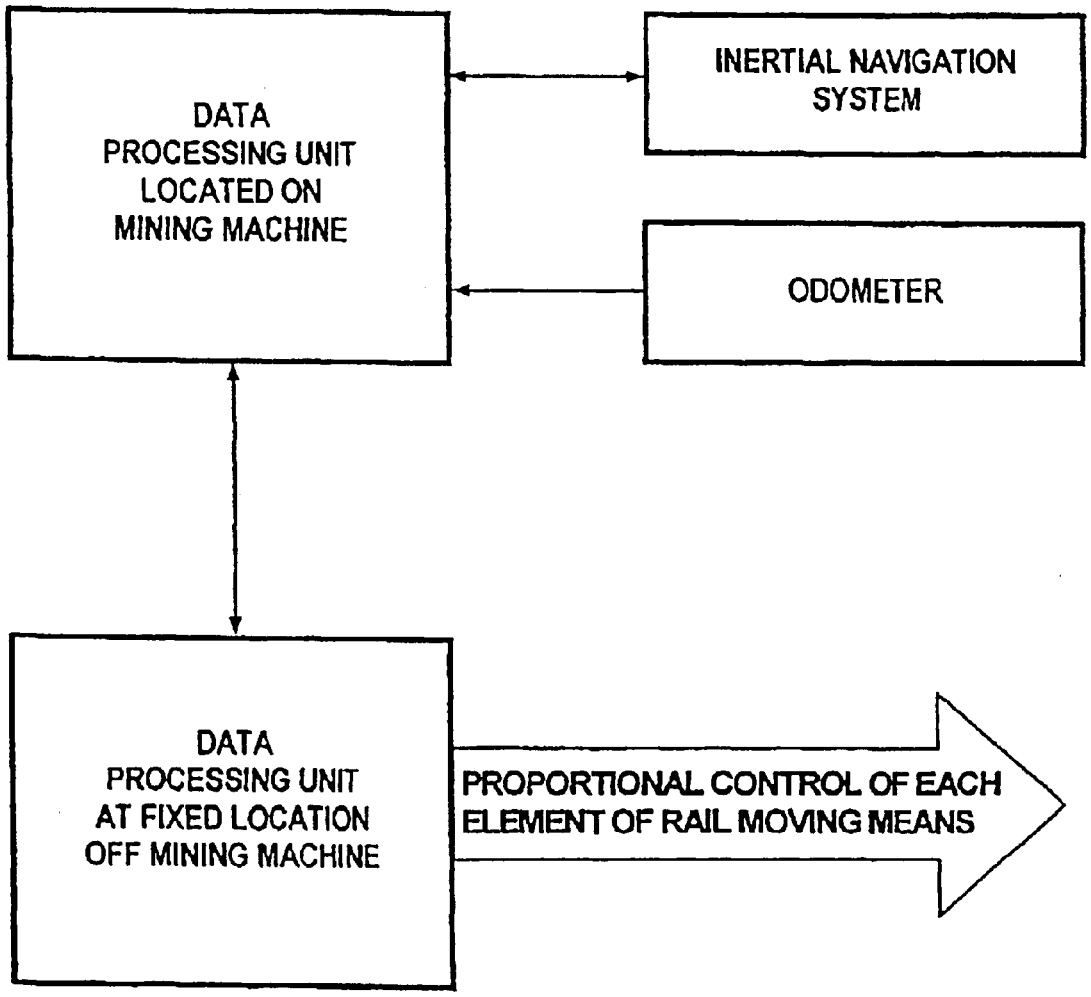
FIG. 7 is an electrical circuit block diagram showing components of an example of a preferred embodiment of the present invention applicable to a prior art mining machine.

FIG. 7 is an electrical block circuit diagram which shows the functional elements of the electrical part of the processing using the 3D positioning means. In this embodiment, an inertial navigation system is provided for determining the position of the mining machine 7. The odometer is used as a simple means for measuring the distance travelled by the mining machine 7 on the rail means 19 and is used to stabilise and improve the accuracy of the inertial navigation system. This, in turn, permits the position of the mining machine 7 to be determined across the coal face 3 so that the positions $X_1$ $X_2$ $X_3$ . . . $X_n$ can be determined.

Output signals from the inertial navigation system and the odometer are then passed to a data processing unit located on the mining machine 7. That data processing unit processes the input signals to permit them to be stored in memory and recalled for subsequent processing as to the distance the rail means 19 is to be moved.

The distance outputs from the data processing unit on the mining machine 7 are then fed to a data processing unit at a fixed location off the mining machine 7 so that the signals for a required roof support means 23 to be moved can be processed independent of the processor on the mining machine 7. Electrical signal outputs are then provided to each of the moving means 25 associated with each of the roof support means 23 so as to move the rail means 19, and then subsequently the roof support means 23. Individual control circuits for effecting movement of the roof support means 23 to support the roof and the strata 13 above the seam 1 are appropriately interfaced into this data processing means.

Figure 8:
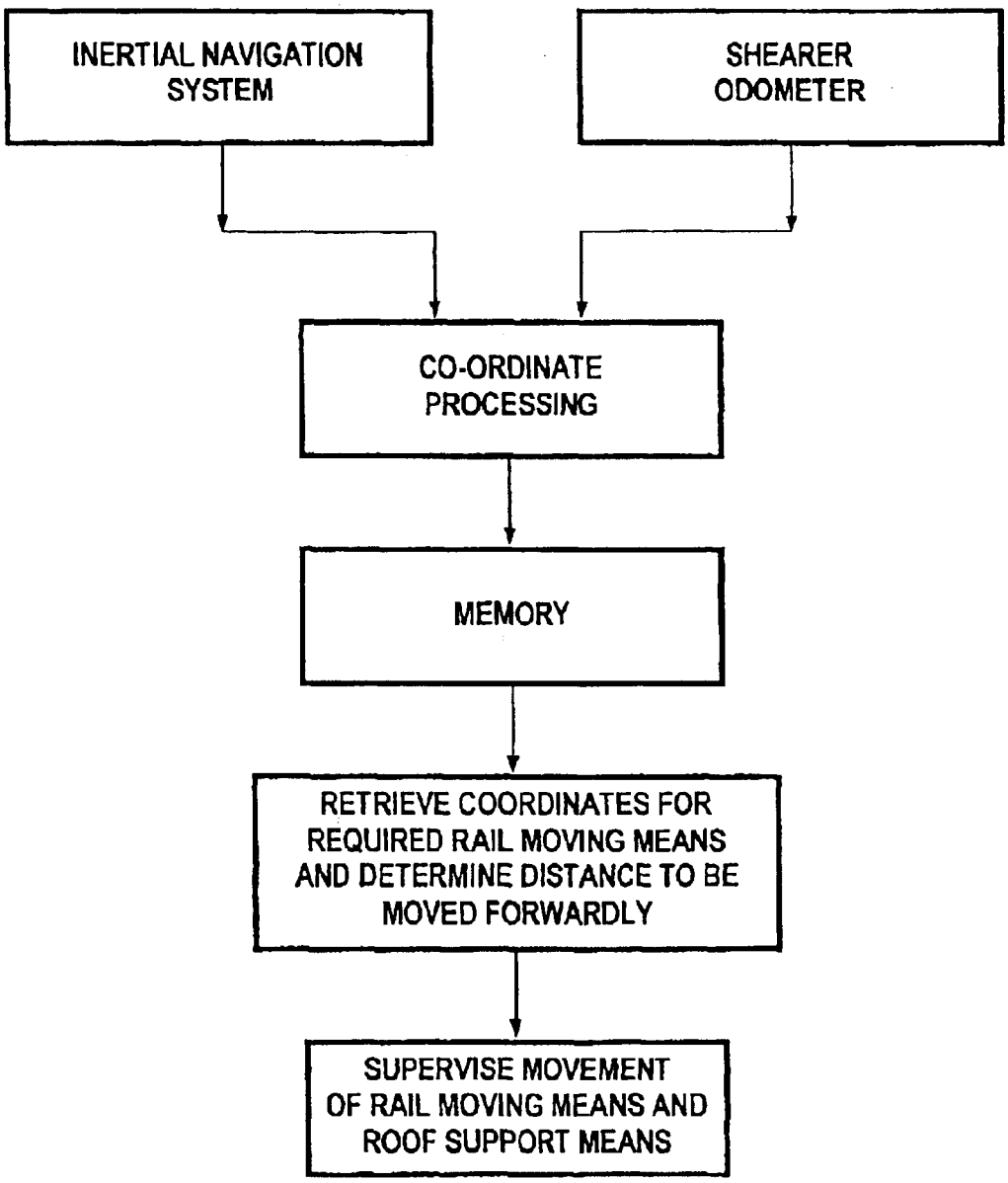
FIG. 8 is a functional flow diagram of the software processes associated with the preferred example of the prior art mining machine.

FIG. 8 shows a functional flow diagram of the process steps in the system. It can be seen therefore that data signals are provided from the inertial navigational system and from the odometer and that these are fed into a co-ordinate processing module. That module determines the co-ordinates at the various positions $X_1$ $X_2$ $X_3$ . . . $X_n$ along the rail means 19 and stores that information in the memory. In addition to the above, the up and down movements of the shearing head 9 are also stored in the memory. As the mining machine 7 progresses along the rail means 19 a trailing part of the rail means 19 is to be moved forwardly towards the seam. A further software module then retrieves from memory the co-ordinates for the required roof support means 23 to be moved and determines a distance for forward movement. This information is then passed to the external processor to the machine 7 so that movement of the roof support means 23 can be supervised externally of the processor on the mining machine 7.

Figure 9:
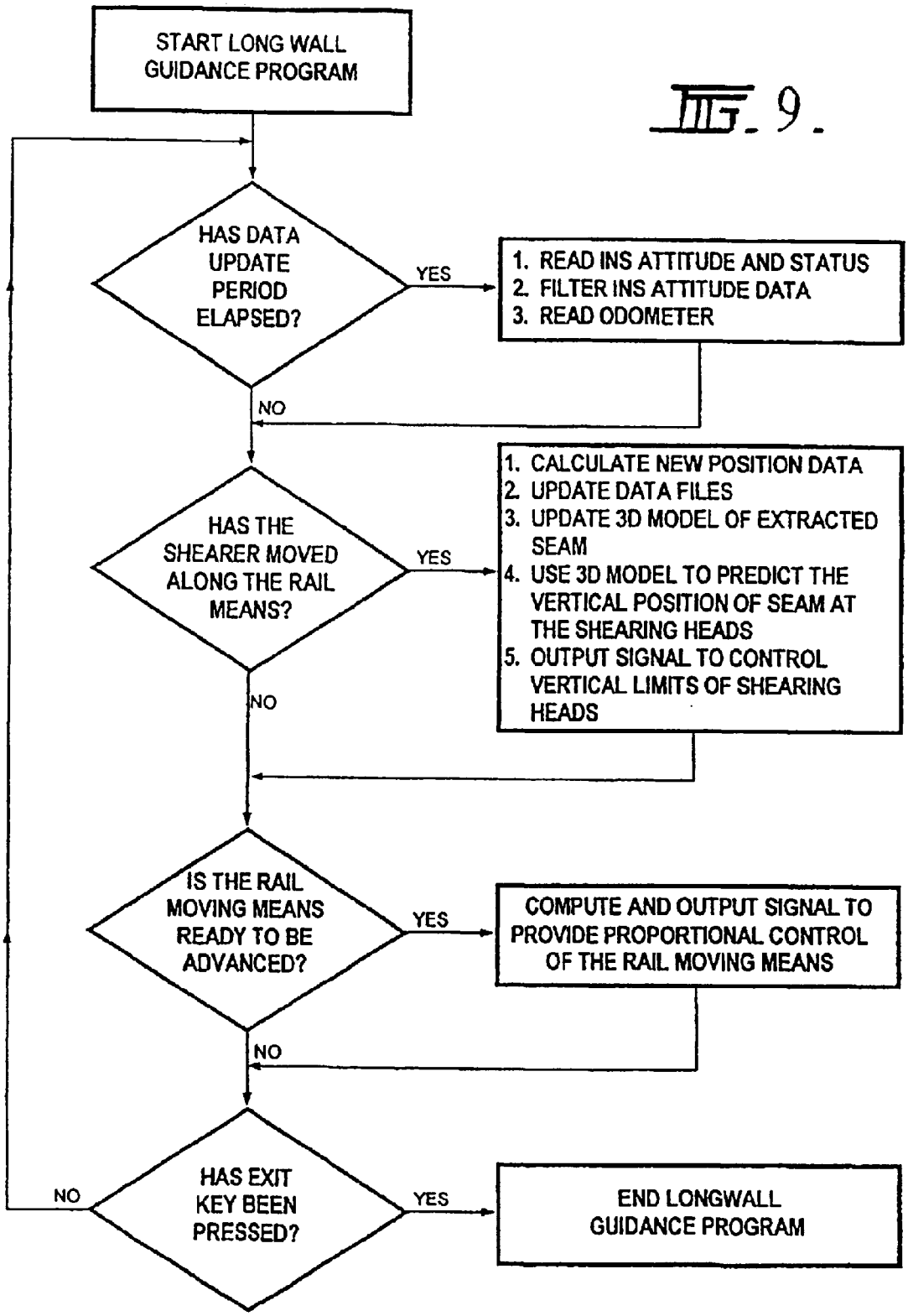
FIG. 9 is a software flow diagram showing process steps in the preferred example of the prior art mining machine according to the present invention.

FIG. 9 is a software flow diagram showing the software processes from the start of a longwall mining process to the end of a longwall mining process during a mining session. The process steps are self-explanatory with the only exception being the function "HAS EXIT KEY BEEN PRESSED". This function is to determine that the stop button (exit key) has been pressed on the mining machine, thus, terminating a mining session.

Whilst the mining machine has been described in the preferred example in relation to a longwall mining machine for mining coal, it should be understood that the concepts of the invention are applicable to other mining applications and not limited to longwall mining itself or to mining of coal itself.

The longwall mining process shown in the preferred examples, is known in the industry as Bi-di. Other modes are also known being Uni-di and Half-web. No doubt other modes will be developed in the future. The invention is universally adopted to all such modes and is not to be considered as applicable to only the Bi-di mode. Thus, whatever mode is adopted, the invention is applicable to moving the rail means to assume a desired geometry within the available void in the mine. Further, whilst it has been described that the rail means extends completely across the seam from side-to-side, the rail means may extend only a part way across the seam, and be moved at some subsequent stage to mine from a different part of the seam width. All such modifications are deemed to be within the scope of the invention and the appended claims.

Modifications may be made to the invention which as would be apparent to persons skilled in the art of mining and/or electronic/hydraulic circuit controls. These and other modifications may be made without departing from the end bit of the invention the nature of which is to be determined from the foregoing description.

The claims defining the invention are as follows:

1. A mining machine comprising:

a shearing head mounted on a moveable carriage, said shearing head being for mining product from a scam as said moveable carriage traverses from aide-to-side across a mining face of said seam on rail means which extend from side-to-side across the seam at least 2D co-ordinate position determining means carried entirely by one of the movable carriage and the rail means for determining the absolute co-ordinate position in space of one the movable carriage and the rail means at each of a plurality of locations along the rail means, said position determining means providing current absolute co-ordinate position output data signals therefrom;

processing means connected to receive the output data signals and to generate and to generated further signals to control rail moving means associated with said machine, so said rail moving means will attempt to displace a trailing part of said rail means a distance towards said seam based on the determined current absolute co-ordinate position of that part of the rail means as distinct from an expected co-ordinate position, to assume a co-ordinate position of an intended profile for the next pass, said processing means operating with said rail moving means at various locations along the length of the rail means, so that on the next pass of said moveable carriage, said shearing head will attempt to cut to the intended profile.

2. A mining machine as claimed in claim 1 wherein the intended profile is a straight line in a generally horizontally extending plane.

3. A mining machine as claimed in claim 1 wherein said processing means includes memory means for storing electrical data signals of the 2D co-ordinates provided by said co-ordinate position determining means at each of said plurality of locations.

4. A mining machine as claimed in claim 1 wherein said data signals are useable by said processing means to calculate the required distance of movement of the rail means at various locations.

5. A mining machine as claimed in claim 1 wherein said co-ordinate position determining means provides 3D coordinate position signals in each of the X, Y and Z planes.

6. A mining machine as claimed in claim 1 wherein said processing means stores a horizon profile of either or both the up or down locations of the shearing head at locations along the rail means, so that on a next pass said shearing head can be predictably controlled by shearing head position control means to be moved to positions which cause said shearing bead to traverse a predicted horizon profile determined from a previous pass, whereby the shearing head can move to predicted folds or contours of the seam.

7. A mining machine as claimed in claim 1 wherein said rail moving means is a series of independently moveable moving means spaced apart along the length of said rail means and wherein each is connected at one end to a respective mine roof support means, each roof support means providing fixed positions for the one ends of each moving means when supporting a mine roof, and wherein the other ends of said moving means are connected to said rail means, so that when the other ends of said moving means are moved away from said roof support means the rail means can be moved forwardly towards said seam.

8. A mining machine as claimed in claim 7 wherein each of said moving means is independently moveably so that when said rail means has been moved forwardly by said moving means, and a respective mine roof support means released from supporting said mine roof, the respective roof support means can be displaced forwardly towards said rail means by said moving means and wherein said rail means then provides fixed positions for the other ends of each moving means.

9. A mining machine as claimed in claim 8 wherein said processing means determines the amount of forward movement of said roof support means so that at completion of a pass of said mining machine along said rail means there is a substantially straight line wall across the seam, and so all the roof support means will then be inline with said line being substantially parallel with said rail means.

10. A mining machine as claimed in claim 1 wherein said co-ordinate position determining means is carried at a fixed point on said mining machine, and the current position of the rail means is related to the position of the fixed point.

11. A method of controlling a mining machine having a moveable carriage carrying a shearing head so said shearing head will cut to an intended profile, said method comprising:

mounting said carriage on rail means so said carriage will be able to traverse from side-to-side across a seam to be mined;

providing a co-ordinate position determining means mounted entirely on one of said rail means and said movable carriage;

generating with the position determining means position signals of the current absolute 2D co-ordinate position in space one of said rail means and said movable carriage at each of plurality of locations along the rail means to processing means as said machine passes from side-to-aide across the seam;

generating output signals processed from said position signals to control rail moving means, effecting operation of said rail moving means so a trailing part of said rail means will be displaced a distance forwardly toward said seam based on the current co-ordinate position of the rail means or said movable carriage as distinct from an expected co-ordinate position, operating said rail moving means at various positions along the length of the rail means so said rail means will attempt to be in said intended profile so that on a next pass of said moveable carriage said shearing head will attempt to cur the intended profile.

12. A method as claimed in claim 11 including storing electrical data signals of the co-ordinates at each of the plurality of locations.

13. A method as claimed in claim 11 including calculating the required distance of displacement of the trailing part of the rail means in processing means based on the co-ordinate position of the rail means at each particular location.

14. A method as claimed in claim 11 including providing said position signals as 3D co-ordinate position signals in each of the X, Y, Z planes.

15. A method as claimed in claim 14 wherein said 3D co-ordinate position signals are stored to obtain 3 Dimensional stored profile of the seam.

16. A method as claimed in claim 11 including storing a horizon profile of either or both the up or down locations of the shearing head at locations along the rail means, and on a next pass, predictably controlling said shearing head to traverse a predicted horizon determined from a previous pass, thereby causing the shearing head to move to predicted folds or contours of the seam.

17. A method as claimed in claim 11 wherein said rail means is moved so there is a substantially straight line wall across the seam after a pass and wherein the rail means is substantially parallel to the straight line wall.

18. A method as claimed in claim 11 including determining the co-ordinate positions by positioning means carried at a fixed point on said mining machine.

19. A method as claimed in claim 11 including determining a distance of movement "$A_n$" of the rail means by processing signals of the co-ordinate positions according to the following relationship $$A_n=|Y_n-X_n|$$

Where $Y_n$=a vector described by the co-ordinates of the position, relative to an origin, after movement And $X_n$=a vector described by the co-ordinates of the position, relative to an origin, before movement And wherein $X_n=X_{n-1}+\Delta X<\theta_n$, and wherein $\Delta X<\theta_n$ is a vector expressed in polar form.

20. A method as claimed in claim 11 including processing said position signals to provide said output signals for said rail moving means by a processor remote from said machine.

* * * * *